United States Patent [19]

Osepchuk

[11] Patent Number: 4,709,129

[45] **Date of Patent: * Nov. 24, 1987**

[54] MICROWAVE HEATING APPARATUS

[75] Inventor: John M. Osepchuk, Concord, Mass.

[73] Assignee: Raytheon Company, Lexington, Mass.

[ * ] Notice: The portion of the term of this patent subsequent to Sep. 16, 1997 has been disclaimed.

[21] Appl. No.: 945,166

[22] Filed: Dec. 22, 1986

Related U.S. Application Data

[63] Continuation of Ser. No. 336,753, Jan. 4, 1982, abandoned, which is a continuation of Ser. No. 132,354, Mar. 20, 1980, abandoned, which is a continuation of Ser. No. 910,045, May 26, 1978, abandoned, which is a continuation of Ser. No. 751,288, Dec. 16, 1976, abandoned.

[51] Int. Cl.[4] ..... H05B 6/64

[52] U.S. Cl. ..... 219/10.55 B; 315/39.51; 315/85; 315/39.71; 313/106

[58] Field of Search ..... 219/10.55 B; 313/106, 313/240; 315/85, 39.51, 39.71; 331/86, 91; 328/249, 252, 253, 262

[56] References Cited

U.S. PATENT DOCUMENTS

| | | | |
|---|---|---|---|
| 2,163,157 | 6/1939 | Samuel | 315/39.51 X |
| 2,487,078 | 11/1949 | Sloan | 313/106 X |
| 2,939,037 | 5/1960 | Jepsen | 313/106 X |
| 3,234,424 | 2/1966 | Henry-Bezy et al. | 313/106 |
| 3,315,121 | 4/1967 | Staats | 219/10.55 BX |
| 3,377,562 | 4/1968 | Staats | 331/86 X |
| 3,396,342 | 8/1968 | Feinberg | 328/262 |
| 3,609,581 | 9/1971 | McDowell | 313/106 X |
| 3,794,879 | 2/1974 | Edwards | 219/10.55 BX |
| 3,988,636 | 10/1976 | Sato et al. | 315/39.51 |
| 4,223,246 | 9/1980 | Osepchuk | 315/39.51 X |

OTHER PUBLICATIONS

*Van Nostrand's Scientific Encyclopedia,* Fifth Edition 1976, Van Nostrand Reinhold Co. N.Y., pp. 1540–1541.

*Primary Examiner*—Philip H. Leung

*Attorney, Agent, or Firm*—William R. Clark; Richard M. Sharkansky

[57] ABSTRACT

A microwave power source for a microwave oven in which a microwave magnetron is supplied simultaneously with filament heater power and with anode voltage through an inductive reactance power supply and has end shields with peripheral depressions to suppress end shield secondary emission oscillations during warm-up of the filament which can rapidly collapse to produce rapid shutoff of anode current and, consequently, undesirably high voltage spikes across the magnetron.

5 Claims, 4 Drawing Figures

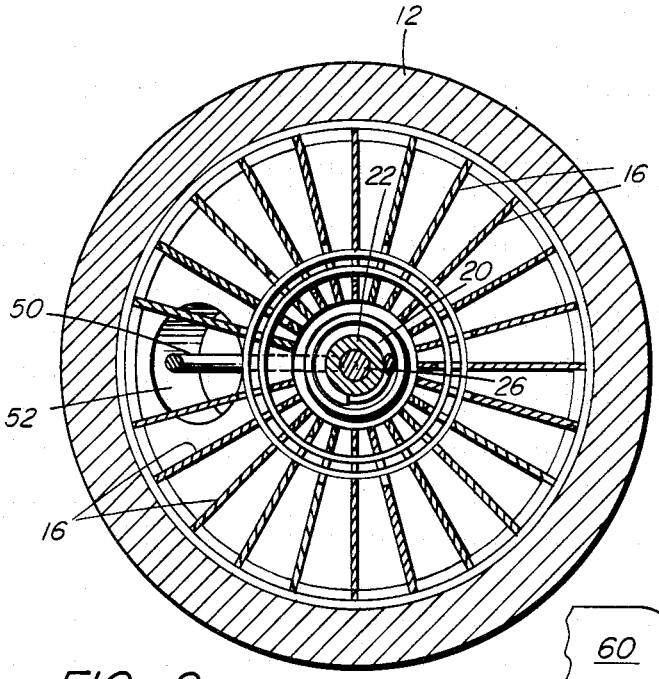
FIG. 2
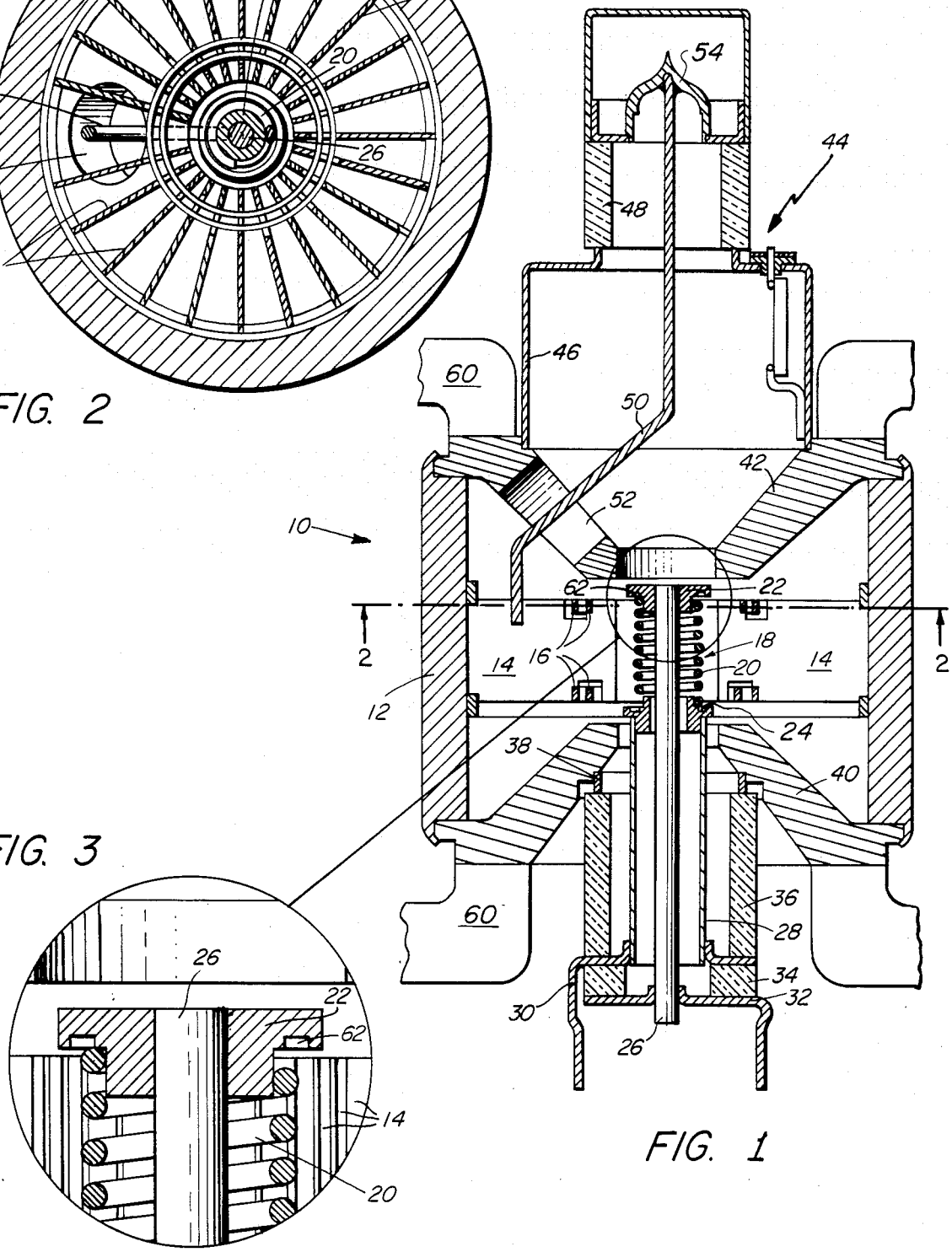
FIG. 3
FIG. 1

MICROWAVE HEATING APPARATUS

CROSS REFERENCE TO RELATED CASES

This application is a continuation of application Ser. No. 336,753, abandoned, filed Jan. 4, 1982, which is a continuation of application Ser. No. 132,354, filed Mar. 20, 1980, now abandoned, which is a continuation of application Ser. No. 910,045, filed May 26, 1978, abandoned, which is a continuation of application Ser. No. 751,288, filed Dec. 16, 1976, abandoned.

BACKGROUND OF THE INVENTION

Magnetrons for microwave ovens have exhibited spurious modes of operation in which a magnetron power supply produces very large voltage spikes across the magnetron which can exceed the voltage ratings of power supply components such as capacitors, rectifiers and transformer winding insulation causing damage to the power supply. In addition, such voltage spikes can exceed the voltage isolation between anode and filament within the magnetron resulting in arcing or other damage to the magnetron.

SUMMARY OF THE INVENTION

This invention discloses the discovery that one reason for voltage spikes from a constant current, or high inductive reactance, power supply is rapid magnetron current cutoff due to collapse of a mode of magnetron oscillation prior to the filament attaining a sufficient temperature to produce copious thermionic emission.

This invention further discloses that a magnetron can be operated during warm-up period of the magnetron filament from a power supply having a large effective inductive reactance in the magnetron anode current path without damage by effectively suppressing secondary emission from end shields of the magnetron in an unstable mode wherein oscillatory power generated by the magnetron rapidly ceases producing cutoff of the anode current and thereby producing high voltage transient spike exceeding the breakdown voltage of the power supply and/or magnetron components producing failure of the system. More specifically, this invention discloses providing regions in portions of the end shields which are substantially free of electric fields and into which a major portion of the electrons emitted by secondary emission from one of the end shields will fall so that secondary electrons produced in such regions will fall back onto the emitting surface and be suppressed. More specifically, this invention provides for annular grooves in the end shields which are coaxial with the axis of the magnetron and which preferably are centered approximately at the cathode surface and have radial widths which are the same order of magnitude as their axial depths.

This invention further discloses that such a method of suppressing secondary emission is particularly useful in a magnetron cathode having a directly heated filament of thoriated tungsten. More specifically, a spiral coil of thoriated tungsten is positioned coaxial with the magnetron and directly connected at its ends to refractory end shields of, for example, molybdenum containing the annular grooves.

This invention further discloses that by suppressing secondary emission from the end shields, the number of such secondary emission electrons which migrate to the anode during operation of the tube under the desired circumstances of copious thermionic emission from the filament surface may be reduced. Since such secondary emission electrons from end shields are less efficiently converted to microwave oscillation energy at the desired frequency than are electrons emitted from the filament, due among other things to the position of the end shields beyond the ends of the anode structure providing the microwave resonant structure of the magnetron, the overall efficiency of the magnetron may be increased by suppressing such end shield secondary emission oscillations.

BRIEF DESCRIPTION OF THE DRAWINGS

Other and further objects and advantages of the invention will be apparent as the description thereof progresses, reference being had to the accompanying drawings wherein:

FIG. 1 illustrates a longitudinal cross-sectional view of a magnetron embodying the invention;

FIG. 2 represents a transverse cross-sectional view of the magnetron shown in FIG. 1 taken along line 2—2 of FIG. 1;

FIG. 3 is an expanded view of an end shield detail shown in FIG. 1; and

DESCRIPTION OF THE PREFERRED EMBODIMENT

Figure 4:
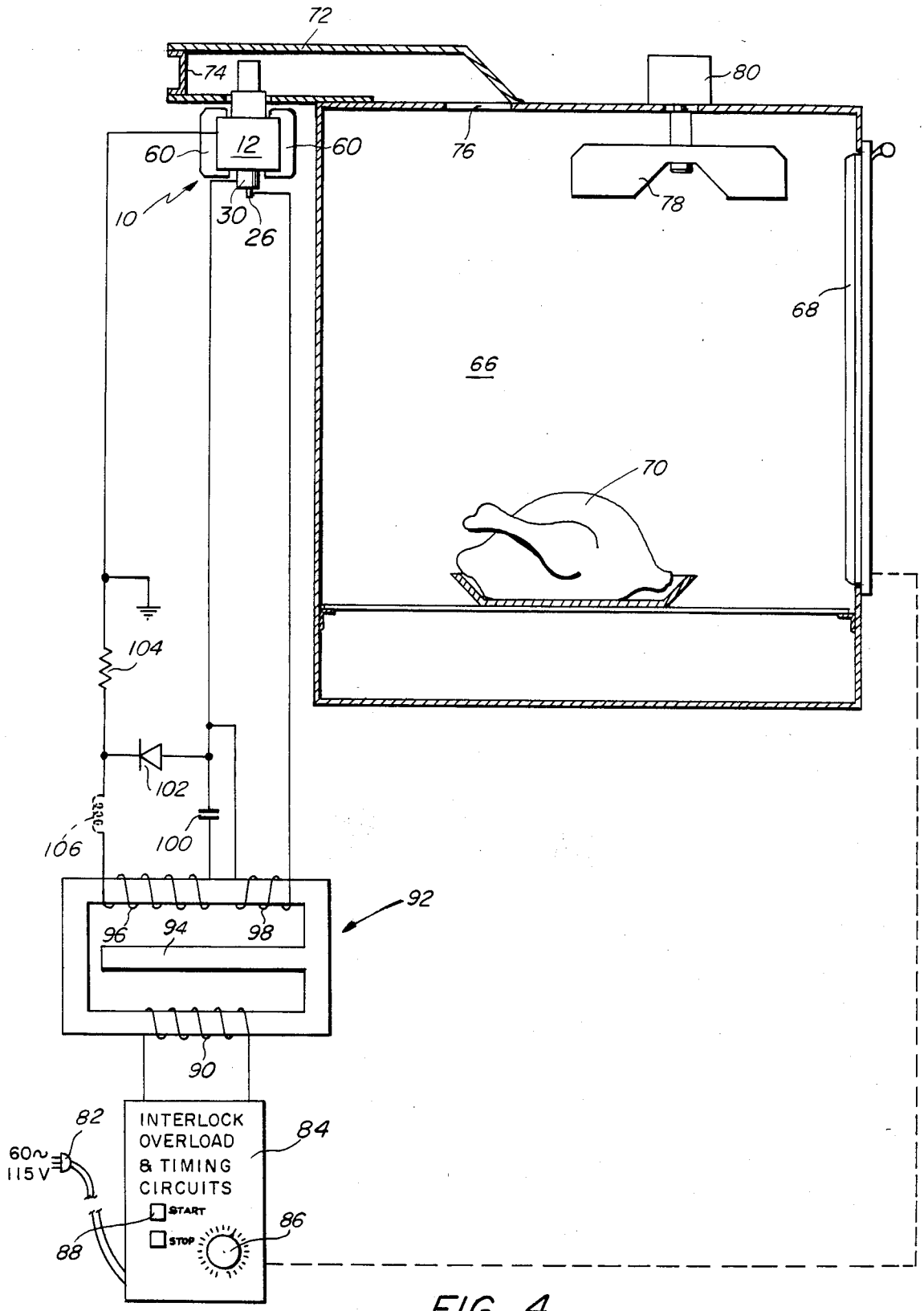
FIG. 4 illustrates a microwave cooking system embodying the invention.

Referring now to FIGS. 1–3, there is shown a magnetron 10 comprising an anode cylinder 12 having a plurality of inwardly extending vanes 14 whose inner ends are alternately interconnected by straps 16 in accordancde with well-known practice. Positioned in the space defined by the inner ends of the vanes 14 is a cathode 18 made up of a spirally coiled directly heated filament 20 made, for example, of thoriated tungsten. Filament 20 is connected at its upper and lower ends to end shields 22 and 24, respectively. Upper end shield 22 is connected to a metal central support lead 26, and lower end shield 24 is connected to a metal cylinder 28. Cylinder 28 is connected to a metal lead-in washer 30 which is rigidly connected with respect to a lead-in washer 32 connected to rod 26 by an insulating washer 34 of, for example, ceramic material. Washer 30 is also connected through a high voltage insulating cylinder 36 surrounding cylinder 28 and bonded to a metal ring 38 which in turn is bonded to a lower magnetic pole piece 40 bonded to anode cylinder 12 and having an aperture through which the cathode assembly 18 is supported in the interaction space adjacent the inner ends of vanes 14. An upper pole piece 42 is sealed to the upper end of cylinder 12.

An output structure 44 extends upwardly from pole piece 42 and comprises a metal cylinder 46 sealed to pole piece 42 and sealed to an output microwave window cylinder 48. An output antenna 50 is connected to the upper edge of one of the vanes 14 and extends through an aperture 52 in pole piece 42 and through cylinder 46 and output window cylinder 48 to be held in place by a metal tubulation tip 54 through which the magnetron has been evacuated and sealed. Tubulation tip 54 is covered by a metal cup bonded to tubulation tip 54. A magnetic field is applied between pole pieces 40 and 42 by a conventional permanent magnet structure 60 which may comprise an annular permanent magnet with a magnet return path.

In the presence of a strong electric field provided between the anode vanes 14 and the cathode 16 and the strong magnetic field between pole pieces 40 and 42, electrons emitted from end shield 22 can spiral to end shield 24 and upon impact produce secondary electrons which spiral back to end shield 22 thereby providing a mode of oscillation. This mode of oscillation is damped when the filament 26 is heated to a sufficient temperature to produce thermionic emission and cause oscillation of the magnetron in the main mode which thereby damps the oscillatory mode of electrons between the end shields 22 and 24. However, prior to a sufficient supply of thermionically emitted electrons, the secondary emission oscillations which can occur between the end shields may rapidly collapse thereby producing an abrupt cessation of current flow from the cathode structure 18 to the anode vanes 14.

In accordance with this invention, annular grooves 62 are provided in the upper and lower end shields 22 and 24, facing each other. Such grooves, as shown in greater detail in FIG. 3, preferably have their concentric inner walls spaced at about the same distance from the axis of the cathode as the center of the filament wire 20. The radial width of grooves 62 is of the same order of magnitude as their axial depths. Grooves 62, in addition, are made sufficiently deep that the DC electric field extending from the anode vanes 14 to the cathode does not provide any substantial gradient at the bottoms of the grooves 62. Thus, electrons which would otherwise produce sufficient secondary emission by spiraling around the cathode and moving axially of the magnetron to impact on the end shields and produce secondary emission electrons do not provide a sufficient number of such electrons in the region of a sufficiently high DC electric field gradient to permit build-up of oscillations in the absence of thermionic emission from the filament 20. Therefore, abrupt anode current interruption during filament warm-up phase of the magnetron is suppressed.

Referring now to FIG. 4, there is shown a microwave oven heating system having a power supply in which the magnetron 10 of FIG. 1 may be used. Such a system includes a microwave enclosure 66 having a door 68 through which a food body 70 may be positioned in the oven. Microwave energy from magnetron 10 is supplied through output window 48 from antenna 50 into a waveguide 72 having one end shorted by a plate 74 and the other end connected to an aperture 76 in the upper wall of cavity 66. A mode strirrer 78, of any desired reflective shape, is rotated in cavity 66 by a motor 80 positioned external to the cavity 66 in accordance with well-known practice.

Power is supplied to the oven from a 60-cycle 115-volt source via a plug 82 to an interlock overload and timing circuit 84 which is mechanically interconnected with an interlock switch system mechanically actuated by door 68 in accordance with well-known practice. A timer 86 in timing circuit 84 is set to the desired cooking time and, upon energization of the system by pushing a start button 88, supplies power to the primary winding 90 of a regulating transformer 92 having a saturating leg 94, a high voltage secondary winding 96 and a low voltage secondary filament heater winding 98. Low voltage secondary winding 98 is connected between washers 30 and 32 of magnetron 10 to supply heater power to filament 20. High voltage secondary winding 96 has one end connected through a condenser 100 to one end of low voltage winding 98 and through a high voltage rectifier 102 to the other end of winding 96, said other end being connected to ground through a current limiting resistor 104 and, hence, to anode cylinder 12 of magnetron 10 which is also grounded.

Transformer 92 is of the regulating type shown, for example, in the Advance Transformer U.S. Pat. No. 3,396,342 and has a substantial leakage reactance illustrated by the dotted coil 106 in series between one end of the high voltage winding 96 and the resistor 104. Such leakage reactance serves to prevent excessive peak currents through rectifier 102 when condenser 100 is being charged as well as to provide a substantially constant current source for the high voltage current supplied to the magnetron 10 which thereby regulates the power output of the magnetron 10. Preferably, the power supply has secondary peak voltage for winding 96 with no current drawn of around 4000 volts, and the magnetron has a cutoff voltage of around 4000 volts which must be exceeded for the magnetron to conduct. The circuit thus shown is a modified half wave voltage doubler in which in one cycle current flows through diode 102 to charge the side of condenser 100 positive with respect to the side of condenser 100 connected to the magnetron filament. On the opposite cycle of the sine wave, the cathode 18 of the magnetron is driven negative by the amount of the charge on the condenser 100 and the voltage generated across winding 96 added in series, producing a current through magnetron 10 which limits the voltage developed across winding 96 by a reverse voltage developed across the equivalent leakage reactance 106 to the necessary voltage required to produce a current flow of, for example, 600 milliamps through magnetron 10. As the inductive reactance produced by 106 saturates, the voltage across condenser 100 drops, preferable the size of condenser 100 being chosen to produce a relatively uniform current. Thus, a pulse of microwave energy is supplied to the oven 66 sixty times a second until the timer 86 shuts off the power to the transformer 92 at which time the oven door 68 may be opened and the food body 70 removed. As may be seen, prior to the warm-up of the filament 20, a total voltage peak of twice the voltage of winding 96, or about 8000 volts, may be produced across the magnetron 10, and under these circumstances, secondary emission from the end shields can cause oscillation of the magnetron which, upon collapse, creates a reversal of the voltage across leakage reactance 106, adding to the 8000 volts to produce voltages limited by the shunt capacitance produced by a shield (not shown) around the cathode through which the cathode connections are fed through feed insulators (not shown) so that voltages of 20,000 to 50,000 volts may be produced in the reverse direction across the diode 102 and the winding 96 as well as between the winding 98 and the transformer core and the insulating covering of the winding (not shown). However, in accordance with this invention, such a power supply operating with condenser 100 sized to produce optimum regulation and waveform shape for efficiency and stability may be achieved.

This completes the description of the embodiment of the invention illustrated herein. However, many modifications thereof will be apparent to persons skilled in the art without departing from the spirit and scope of this invention. For example, power supplies operating at higher switching rates than 60 cycles may be used, the magnetron may have an electromagnetic magnet rather than the permanent magnet disclosed, and the power supply can be a full wave rectifier circuit instead of the half wave rectifier circuit shown. Also, the form, number and shape of the grooves can be varied, for example, to have traperoidal, triangular, arcuate or other cross-sectional shapes. Accordingly, it is intended that this invention be not limited by the particular details illustrated herein except as defined by the appended claims.

What is claimed is:

1. A microwave source comprising:

a microwave magnetron having a directly heated thermionically emissive electron source surrounded by an anode;

said source comprising a coiled thermionically electron emissive filament whose axis is substantially coaxial with said anode, said source having end shields electrically connected to each of the ends of said filament beyond the ends of said anode;

a high voltage direct current power supply presenting a substantially inductive reactance in series with said anode and said source of said magnetron to provide a unidirectional electric field in the region between said source and said anode;

the major portion of said electric field extending radially from said filament to said anode and a minor component of said electric field in the region of said end shields extending parallel to the axis of said filament;

said magnetron having a unidirectional magnetic field in said region having a major component orthogonal to said major component of said electric field;

means for inhibiting microwave oscillations produced in said magnetron by secondary electron emission from said end shields due to motion of electrons having a component axial to said filament produced by said minor component of said electric field when said source is below temperatures producing substantial thermionic emission of electrons; and said inhibiting means comprising an annular groove in at least one of said end shields, said groove extending radially beyond the surface of the cylindrical volume defined by said filament.

2. The microwave source in accordance with claim 1 wherein:

said anode comprises a plurality of resonant cavities surrounding said electron emissive source.

3. A microwave magnetron comprising:

an evacuated envelope containing a plurality of cavity resonators surrounding a cylindrical interaction space surrounding a directly heated thermionically emissive elongated electron source;

said source comprising a coiled electron thermionically emissive filament whose axis is coaxial with said interaction space and whose ends are electrically connected to end shields positioned beyond the ends of said resonators;

said end shields extending radially from the axis of said coiled filament to points beyond the surface of the cylindrical volume defined by said coiled filament to provide conductive surfaces at opposite ends of said interaction space;

means for producing mutually orthogonal unidirectional electric and magnetic fields in said interaction space;

said unidirectional magnetic field having its major components parallel to said axis of said coiled filament;

said means for producing a unidirectional electric field comprising a direct current power supply;

said unidirectional electric field extending between said filament and the inner ends of said cavity resonators with the portions of said unidirectional electric field between said resonators and said end shields having components which extend parallel to said magnetic field and to said axis;

means for substantially inhibiting microwave oscillations produced by secondary emission of electrons from said end shields due to said components of said electric field when said electron source is below a temperature producing substantial thermionic emission of electrons; and said inhibiting means comprising annular grooves in the portions of said surfaces of said end shields extending radially beyond said cylindrical region defined by said filament at the ends of said interaction space.

4. The microwave magnetron in accordance with claim 3 wherein:

said filament is a directly heated thoriated tungsten filament; and said filament is supported by said end shields with said filament being heated by current passing through said end shields and said filament.

5. A microwave oven comprising:

a microwave cavity;

a microwave magnetron having an anode and a directly heated thermionically emissive electron source;

said magnetron being coupled to said cavity and being supplied with high voltage from a power supply presenting a substantial inductive reactance in series with said anode and said source of said magnetron;

said source comprising a coiled thermionically electron emissive filament having end shields;

said end shields extending radially from the axis of said coiled filament to points beyond the cylindrical volume defined by said coiled filament and providing conductive surfaces at the ends of the interaction space between said anode and said source; and said surfaces of said end shields having grooves which are substantially concentric with the axis of said filamentary volume and whose bottoms are substantially free of the component of the unidirectional electric field produced during operation of said magnetron by application of a voltage between said anode and said source for inhibiting microwave oscillations in said magnetron by secondary electron emission from said end shields when said filament is below temperatures producing substantial thermionic emission of electrons.

* * * * *